US011646150B2

(12) United States Patent
Kim

(10) Patent No.: US 11,646,150 B2
(45) Date of Patent: May 9, 2023

(54) COIL ELECTRONIC COMPONENT

(71) Applicant: SAMSUNG ELECTRO-MECHANICS CO., LTD., Suwon-si (KR)

(72) Inventor: Jae Hun Kim, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 864 days.

(21) Appl. No.: 16/525,726

(22) Filed: Jul. 30, 2019

(65) Prior Publication Data

US 2020/0328023 A1 Oct. 15, 2020

(30) Foreign Application Priority Data

Apr. 12, 2019 (KR) ..... 10-2019-0043220

(51) Int. Cl.
*H01F 5/00* (2006.01)
*H01F 27/29* (2006.01)
(Continued)

(52) U.S. Cl.
CPC ..... *H01F 27/29* (2013.01); *H01F 27/2804* (2013.01); *H01F 27/323* (2013.01); *H01F 2027/2809* (2013.01)

(58) Field of Classification Search
CPC ..... H01F 27/2804
(Continued)

(56) References Cited

U.S. PATENT DOCUMENTS

2008/0290977 A1* 11/2008 Ito ..... H01F 17/0013 336/184
2016/0086720 A1* 3/2016 Jeong ..... H01F 27/292 336/200
(Continued)

FOREIGN PATENT DOCUMENTS

JP 2006-108383 A 4/2006
JP 2018-207028 A 12/2018
(Continued)

OTHER PUBLICATIONS

Korean Office Action dated Apr. 13, 2020 issued in Korean Patent Application No. 10-2019-0043220 (with English translation).

*Primary Examiner* — Ronald Hinson
(74) *Attorney, Agent, or Firm* — Morgan, Lewis & Bockius LLP

(57) ABSTRACT

A coil electronic component includes a body having first and second surfaces opposing each other, and third and fourth surfaces connecting the first and second surfaces to each other and opposing each other, an insulating substrate disposed in the body and including an end portion having one side surface exposed externally of the body, first and second coil portions disposed on one surface and the other surface of the insulating substrate opposing each other, respectively, a first lead-out portion connected to the first coil portion, disposed on one surface of the insulating substrate, and exposed from the body, a second lead-out portion connected to the first coil portion, disposed on the other surface of the insulating substrate, and exposed from the body, and a direction indicator disposed on at least one of one surface and the other surface of the end portion opposing each other.

21 Claims, 7 Drawing Sheets

(51) Int. Cl.
*H01F 27/32* (2006.01)
*H01F 27/28* (2006.01)

(58) Field of Classification Search
USPC ..... 336/200
See application file for complete search history.

(56) References Cited

U.S. PATENT DOCUMENTS

| | | | | |
|---|---|---|---|---|
| 2016/0268038 | A1* | 9/2016 | Choi | H01F 27/255 |
| 2017/0018351 | A1* | 1/2017 | Yatabe | H01F 27/2804 |
| 2018/0358169 | A1 | 12/2018 | Nishikawa et al. | |
| 2019/0013142 | A1 | 1/2019 | Kim et al. | |

FOREIGN PATENT DOCUMENTS

| | | | |
|---|---|---|---|
| KR | 10-2016-0108935 | A | 9/2016 |
| KR | 10-2017-0060296 | A | 6/2017 |
| KR | 10-2019-0004916 | A | 1/2019 |

* cited by examiner

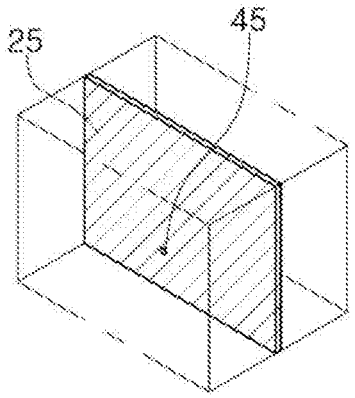
FIG. 5A
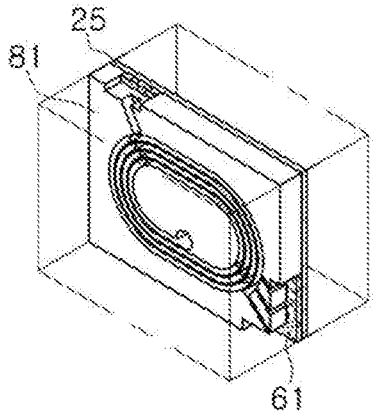
FIG. 5B
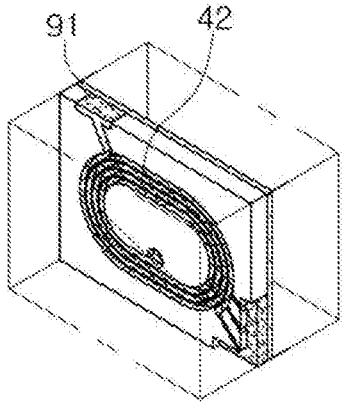
FIG. 5C
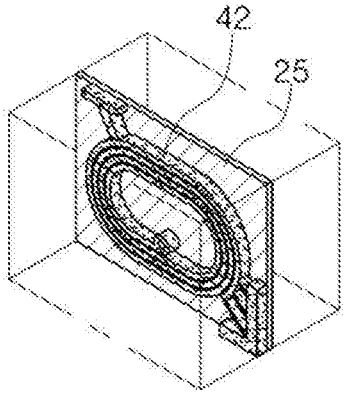
FIG. 5D
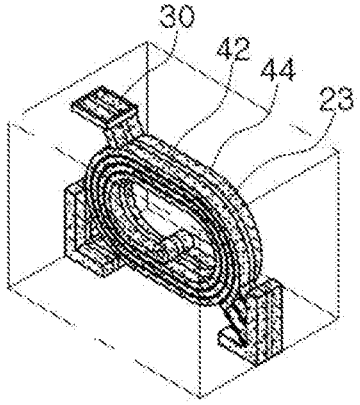
FIG. 5E
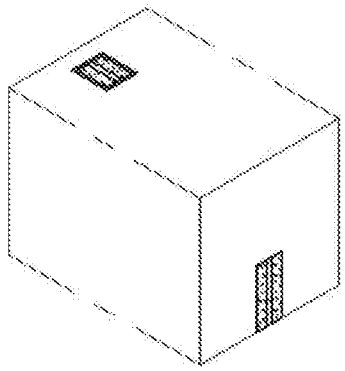
FID. 5F

COIL ELECTRONIC COMPONENT

CROSS-REFERENCE TO RELATED APPLICATION(S)

This application claims benefit of priority to Korean Patent Application No. 10-2019-0043220 filed on Apr. 12, 2019 in the Korean Intellectual Property Office, the disclosure of which is incorporated herein by reference in its entirety.

TECHNICAL FIELD

The present disclosure relates to a coil electronic component.

BACKGROUND

An inductor, one type of coil component, is a passive electronic component used in electronic devices along with a resistor and a capacitor.

When a coil component is mounted on a substrate, mutual inductance with other coil components may occur, and overall inductance may increase or decrease due to mutual inductance. Accordingly, it has been required to mark a direction of rotation of an internal coil in a coil component.

As electronic devices have been designed to have high performance and reduced sizes, an increased number of coil components have been used in electronic devices and sizes of coil components have been reduced. Accordingly, it has been necessary to provide an electronic component in which a direction of rotation of a coil may easily be identified in a direction of an upper surface of a coil component without increasing the number of processes.

SUMMARY

An aspect of the present disclosure is to provide an electronic component having a reduced size in which a direction of rotation of a coil may be easily identified in a direction of an upper surface of a coil electronic component without increasing a number of processes.

According to an aspect of the present disclosure, a coil electronic component includes a body having a first surface and a second surface opposing each other, and a third surface and a fourth surface connecting the first surface and the second surface to each other and opposing each other, an insulating substrate disposed in the body and including an end portion having one side surface exposed externally of the body, first and second coil portions disposed on one surface and the other surface of the insulating substrate opposing each other, respectively, a first lead-out portion connected to the first coil portion, disposed on one surface of the insulating substrate, and exposed from the body, a second lead-out portion connected to the first coil portion, disposed on the other surface of the insulating substrate, and exposed from the body, and a direction indicator disposed on at least one of one surface and the other surface of the end portion opposing each other.

According to an aspect of the present disclosure, a coil electronic component includes a body having a first surface and a second surface opposing each other, and a third surface and a fourth surface connecting the first surface and the second surface to each other and opposing each other; an insulating substrate disposed in the body; first and second coil portions disposed on one surface and the other surface of the insulating substrate opposing each other, respectively;

a first lead-out portion connected to the first coil portion, disposed on the one surface of the insulating substrate, and exposed from the body; a second lead-out portion connected to the second coil portion, disposed on the other surface of the insulating substrate, and exposed from the body; a direction indicator disposed in the body and having one side surface exposed externally of the body; and an insulating film disposed between the direction indicator and the body.

According to an aspect of the present disclosure, a coil electronic component includes a body; an insulating substrate disposed in the body; an internal coil portion disposed on at least one of one surface and the other surface of the insulating substrate opposing each other; and a direction indicator including a first conductor layer and a second conductor layer disposed on the first conductor layer, and disposed in the body and having one side surface exposed externally of the body.

BRIEF DESCRIPTION OF DRAWINGS

The above and other aspects, features, and advantages of the present disclosure will be more clearly understood from the following detailed description, taken in conjunction with the accompanying drawings, in which:

FIGS. 5A-5F are diagrams illustrating processes of manufacturing a coil electronic component in order according to an example embodiment of the present disclosure;

DETAILED DESCRIPTION

Figure 1:
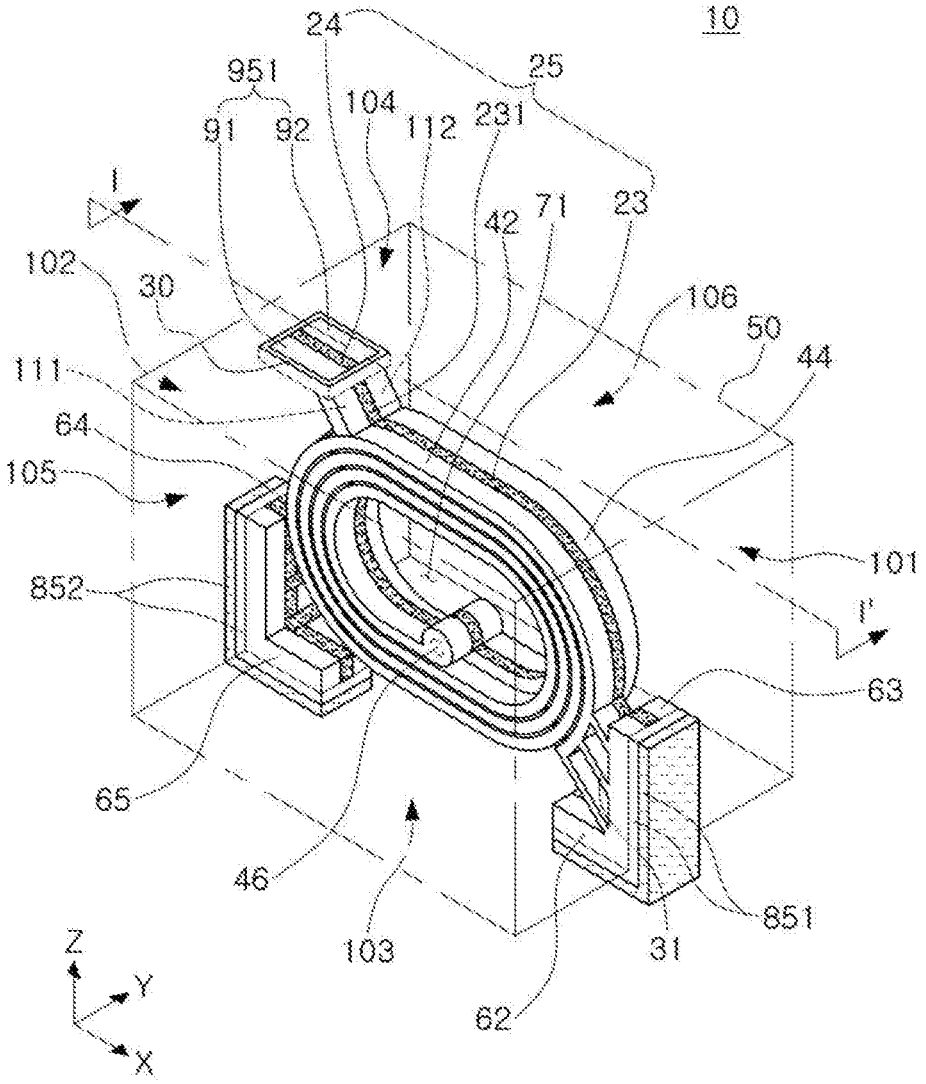
FIG. 1 is a perspective diagram illustrating a coil electronic component according to an example embodiment of the present disclosure.

Hereinafter, embodiments of the present disclosure will be described as follows with reference to the attached drawings.

The terms used in the following description are provided to explain a specific exemplary embodiment and are not intended to be limiting. A singular term includes a plural form unless otherwise indicated. The terms, "include," "comprise," "is configured to," etc. of the description are used to indicate the presence of features, numbers, steps, operations, elements, parts or combination thereof, and do not exclude the possibilities of combination or addition of one or more features, numbers, steps, operations, elements, parts or combination thereof. Also, the terms "disposed on," "positioned on," "mounted on," and the like, may indicate that an element may be disposed on or below another element, and do not necessarily indicate that an element is only disposed in an upper portion with reference to a gravitational direction.

It will be understood that when an element is "coupled with/to" or "connected with" another element, the element may be directly coupled with/to another element, and there may be an intervening element between the element and another element.

Sizes and thicknesses of elements illustrated in the drawings are merely examples to help understanding of technical matters of the present disclosure.

In the drawings, an X direction is a first direction or a length direction, a Y direction is a second direction or a width direction, a Z direction is a third direction or a thickness direction.

In the drawings, same elements will be indicated by same reference numerals. Also, redundant descriptions and detailed descriptions of known functions and elements that may unnecessarily make the gist of the present invention obscure will not be provided.

In electronic devices, various types of electronic components may be used, and various types of coil components may be used between the electronic components to remove noise, and other purposes.

In an electronic device, a coil component may be used as a power inductor, an HF inductor, a general bead, a GHz bead, a common mode filter, and the like.

In the description below, an example embodiment in which a coil electronic component 10 is implemented as a thin film inductor used in a power line of a power supply circuit will be described. The coil component in example embodiments may also be implemented as a chip bead, a chip filter, and the like, other than a thin film inductor.

Example Embodiment

Figure 2:
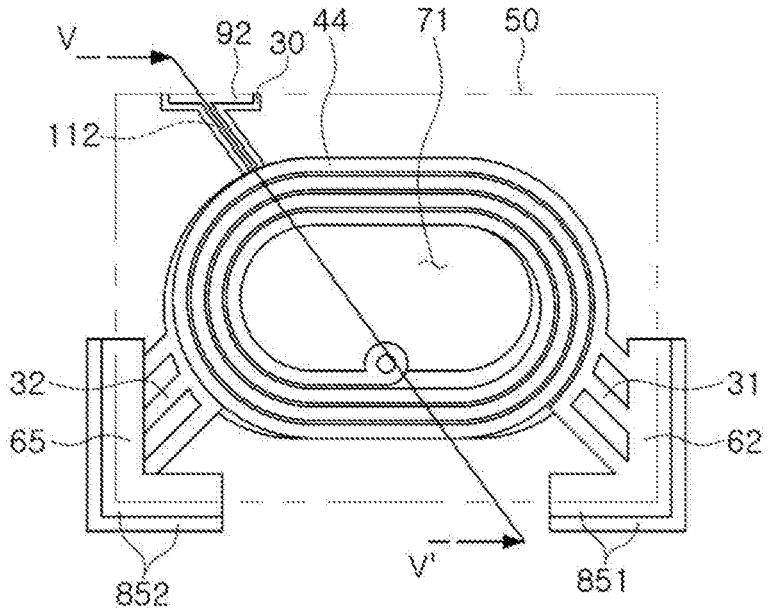
FIG. 2 is a cross-sectional diagram illustrating a body of a coil electronic component illustrated in FIG. 1 viewed from a fifth surface of the body according to an example embodiment of the present disclosure.
Figure 3:
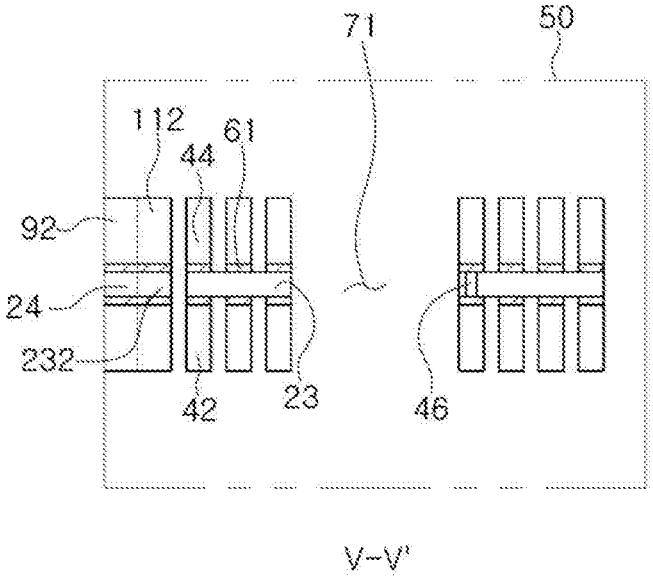
FIG. 3 is a diagram illustrating a cross-sectional diagram taken along line V-V' in FIG. 2.
Figure 4:
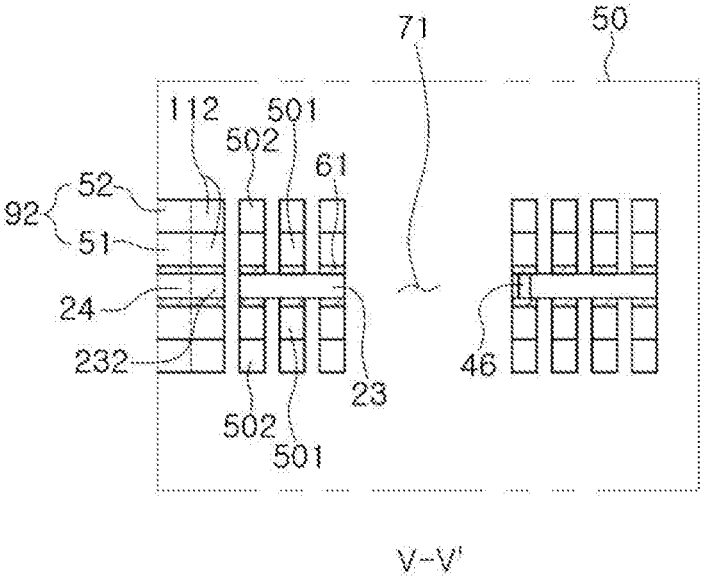
FIG. 4 is a diagram illustrating a modified example of an example illustrated in FIG. 3.
Figure 6:
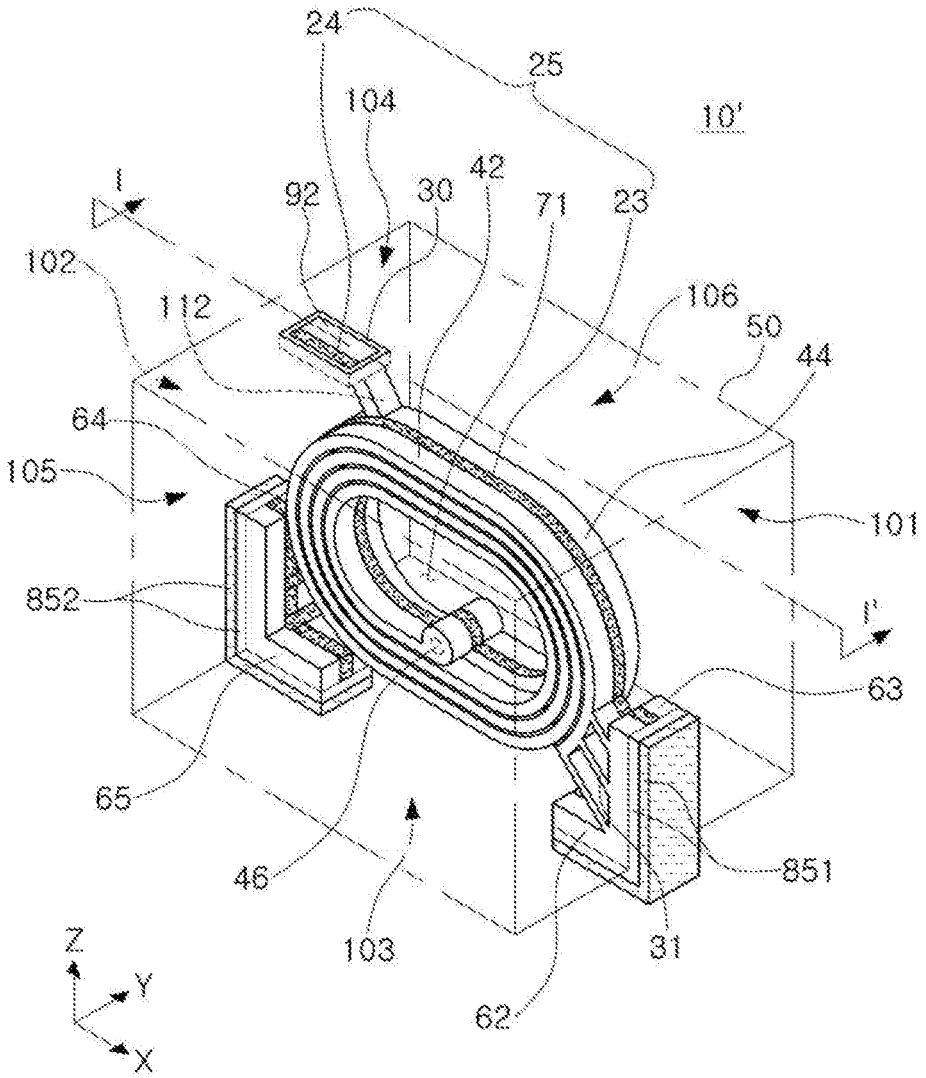
FIG. 6 is a perspective diagram illustrating a coil electronic component according to another modified example of the present disclosure.

FIG. 1 is a perspective diagram illustrating a coil electronic component according to an example embodiment. FIG. 2 is a cross-sectional diagram illustrating a body of a coil electronic component illustrated in FIG. 1 viewed from a fifth surface of the body according to an example embodiment. FIG. 3 is a diagram illustrating a cross-sectional diagram taken along line V-V' in FIG. 2. FIG. 4 is a diagram illustrating a modified example of an example illustrated in FIG. 3. FIGS. 5A-5F are diagrams illustrating processes of manufacturing a coil electronic component according to an example embodiment. FIG. 6 is a perspective diagram illustrating a coil electronic component according to another modified example.

Referring to FIGS. 1 to 6, a coil electronic component 10 may include a body 50, an insulating substrate 25, coil portions 42 and 44, lead-out portions 62 and 64, and a direction indicator 951, and may further include first and second connection patterns 111 and 112, an insulating film 30, connection conductors 31 and 32, dummy lead-out portions 63 and 65, and external electrodes 851 and 852.

The body 50 may form an exterior of the coil electronic component 10, and may include the insulating substrate 25 disposed therein.

The body 50 may have a hexahedral shape.

The body 50 may include a first surface 101 and a second surface 102 opposing each other in a length direction (X), a third surface 103 and a fourth surface 104 opposing each other in a thickness direction (Z), and a fifth surface 105 and a sixth surface 106 opposing each other in a width direction (Y). The third surface 103 and the fourth surface 104 may connect the first surface 101 and the second surface 102 of the body 50 opposing each other.

The body 50 may be configured such that the coil electronic component 10 including the external electrodes 851 and 852 disposed therein may have a length of 0.2±0.1 mm, a width of 0.25±0.1 mm, and a thickness of 0.4 mm, but an example embodiment thereof is not limited thereto.

The body 50 may include a magnetic material and an insulating resin. For example, the body 50 may be formed by layering one or more magnetic material sheets including an insulating resin and a magnetic material dispersed in the insulating resin. The body 50 may also have a structure different from the structure in which a magnetic material is disposed in an insulating resin. For example, the body 50 may be formed of a magnetic material such as ferrite.

The magnetic material may be ferrite power or magnetic metal power.

The ferrite power may be one or more of spinel ferrite such as Mg—Zn based ferrite, Mn—Zn based ferrite, Mn—Mg based ferrite, Cu—Zn based ferrite, Mg—Mn—Sr based ferrite, Ni—Zn based ferrite, and the like, hexagonal ferrite such as Ba—Zn based ferrite, Ba—Mg based ferrite, Ba—Ni based ferrite, Ba—Co based ferrite, Ba—Ni—Co based ferrite, and the like, garnet ferrite such as Y based ferrite, and Li based ferrite, for example.

The magnetic metal power may include at least one of iron (Fe), silicon (Si), chromium (Cr), cobalt (Co), molybdenum (Mo), aluminum (Al), niobium (Nb), copper (Cu), and nickel (Ni) or alloys thereof. For example, the magnetic metal power may be at least one or more of pure iron powder, Fe—Si based alloy power, Fe—Si—Al based alloy power, Fe—Ni based alloy power, Fe—Ni—Mo based alloy power, Fe—Ni—Mo—Cu based alloy power, Fe—Co based alloy power, Fe—Ni—Co based alloy power, Fe—Cr based alloy power, Fe—Cr—Si based alloy power, Fe—Si—Cu—Nb based alloy power, Fe—Ni—Cr based alloy power, and Fe—Cr—Al based alloy power.

The magnetic metal power may be amorphous or crystalline. For example, the magnetic metal power may be Fe—Si—B—Cr based amorphous alloy power, but an example embodiment thereof is not limited thereto.

An average diameter of each of the ferrite power and the magnetic metal power may be 0.1 μm to 30 μm, but an example embodiment thereof is not limited thereto.

The body 50 may include two or more different types of magnetic materials disposed in an insulating resin. The technical concept that different types of magnetic materials may be included indicates that the magnetic materials may be distinguished from each other by one of an average diameter, a composition, crystallinity, and shape.

The insulating resin may include one of epoxy, polyimide, a liquid crystal polymer, and the like, or combinations thereof, but an example embodiment thereof is not limited thereto.

The insulating substrate 25 may be disposed in the body 50, and the coil portions 42 and 44 may be disposed on one surface and the other surface of the insulating substrate 25 opposing each other. The insulating substrate 25 may be disposed in the body 50 and may include an end portion 24 having one side surface exposed externally of the body 50, and the direction indicator 951 may be disposed on at least one of one surface and the other surface of the end portion 24 opposing each other. The insulating substrate 25 may further include a support portion 23 disposed between the coil portions 42 and 44 and supporting the coil portions 42 and 44, and a connection portion 231 disposed between the first and second connection patterns 111 and 112.

In an example embodiment, a region other than the end portion 24 may be removed by $CO_2$ laser, or the like, in a process of trimming the insulating substrate 25 after a process of plating the coil portions 42 and 44. By the trimming process, one portion of the insulating substrate 25 disposed in the body 50 may be removed, and one portion of the insulating substrate 25 exposed to one side surface of the body 50, the end portion 24, may be exposed during a subsequent dicing process.

The insulating substrate 25 may be formed of a thermosetting insulating resin such as an epoxy resin, a thermoplastic insulating resin such as a polyimide resin, or an insulating material including a photosensitive insulating resin, or may be formed of an insulating material in which a reinforcement such as glass fiber or an inorganic filler is impregnated in the above-mentioned insulating materials. For example, the insulating substrate 25 may be formed of an insulating material such as prepreg, ajinomoto build-up film (ABF), FR-4, bismaleimide triazine (BT), a photoimageable dielectric (PID), or the like, but an example of the material may not be limited thereto.

As the inorganic filler, at least one or more elements selected from among a group consisting of silica ($SiO_2$), aluminum oxide ($Al_2O_3$), silicon carbide (SiC), barium sulfate ($BaSO_4$), talc, mud, mica power, aluminum hydroxide ($AlOH_3$), magnesium hydroxide ($Mg(OH)_2$), calcium carbonate ($CaCO_3$), magnesium carbonate ($MgCO_3$), magnesium oxide (MgO), boron nitride (BN), aluminum borate ($AlBO_3$), barium titanate (BaTiO3), and calcium zirconate ($CaZrO_3$) may be used.

When the insulating substrate 25 is formed of an insulating material including reinforcement, the insulating substrate 25 may provide improved stiffness. When the insulating substrate 25 is formed of an insulating material which does not include glass fiber, thicknesses of the coil portions 42 and 44 may easily be reduced.

The coil portions 42 and 44 may be disposed on both surfaces of the insulating substrate 25 opposing each other, and may implement properties of the coil electronic component. For example, when the coil electronic component 10 is used as a power inductor, the coil portions 42 and 44 may maintain an output voltage by storing electric fields as magnetic fields, thereby stabilizing power of an electronic device.

In an example embodiment, the coil portions 42 and 44 may be configured to be disposed perpendicularly to the third surface 103 of the fourth surface 104 of the body 50.

The notion that the coil portions 42 and 44 may be disposed perpendicularly to the third surface 103 or the fourth surface 104 of the body 50 may indicate that, as illustrated in FIG. 1, surfaces of the coil portions 42 and 44 in contact with the insulating substrate 25 may be disposed perpendicularly or almost perpendicularly to the third surface 103 or the fourth surface 104 of the body 50. For example, the surfaces of the coil portions 42 and 44 in contact with the insulating substrate 25 may form an angle of 80 to 100° with the third surface 103 or the fourth surface 104 of the body 50.

The coil portions 42 and 44 may be configured to be disposed in parallel to the fifth surface 105 and the sixth surface 106 of the body 50. Thus, surfaces of the coil portions 42 and 44 in contact with the insulating substrate 25 may be in parallel to the fifth surface 105 and the sixth surface 106 of the body 50.

As the body 50 may have a 1608 size or 1006 or less, a thickness of the body 50 may be greater than a width, and a cross-sectional surface of the body 50 taken in an XZ direction may be greater than a cross-sectional surface of the body 50 taken in an XY direction. Accordingly, as the coil portions 42 and 44 maybe disposed perpendicularly to the third surface 103 or the fourth surface 104 of the body 50, an area in which the coil portions 42 and 44 may be disposed may increase.

For example, when a length of the body 50 is 1.6±0.2 mm and a width is 0.8±0.05 mm, a thickness of the body 50 may satisfy a range of 1.0±0.05 mm (1608 size). When a length of the body 50 is 0.2±0.1 and a width is 0.25±0.1 mm, a thickness of the body 50 may satisfy a maximum of 0.4 mm or less (1006 size). As the thickness is greater than the width, the coil portions 42 and 44 may secure a greater area when the coil portions 42 and 44 are disposed perpendicularly to the third surface 103 or the fourth surface 104 of the body 50, as compared to the example in which the coil portions 42 and 44 are disposed horizontally to the third surface 103 or the fourth surface 104 of the body 50. The greater the area of the coil portions 42 and 44, the more the inductance (L) and quality factor (Q) may improve.

In an example embodiment, the coil portions 42 and 44 may include at least one or more coil layers 501 and 502. For example, the first coil portion 42 may include a first coil layer 501 in contact with one surface of the insulating substrate 25, and a second coil layer 502 disposed on the first coil layer 501. The second coil portion 44 may include a first coil layer 501 in contact with the other surface of the insulating substrate 25, and a second coil layer 502 disposed on the first coil layer 501. The first and second coil layers 501 and 502 may have shapes growing in a width direction and a height direction, and may be formed by an isotropic plating process or an anisotropic plating process, but an example embodiment thereof is not limited thereto.

The coil portions 42 and 44 may be formed of a conductive material such as copper (Cu), aluminum (Al), silver (Ag), tin (Sn) , gold (Au) , nickel (Ni) , lead (Pb) , titanium (Ti) , or alloys thereof, and the first and second coil layers 501 and 502 may be formed of the same metal, but an example embodiment thereof is not limited thereto. The direction indicator 951 disposed on the coil portions 62 and 64 and the fourth surface 104 of the body 50 may be formed together by the same plating process, and may include the same metal.

The first coil portion 42 disposed on one surface of the insulating substrate 25 may oppose the second coil portion 44 disposed on the other surface of the insulating substrate 25, and the first coil portion 42 and the second coil portion 44 may be electrically connected to each other through a via electrode 46 disposed in the insulating substrate 25. Thus, the support portion 23 may be disposed between the coil portions 42 and 44, and may support the coil portions 42 and 44 and may secure stiffness. In an example embodiment, the connection portion 231 may be further disposed between the first and second connection patterns 111 and 112. As the connection portion 231 is disposed between the first and second connection patterns 111 and 112, the connection portion 231 may support the connection patterns 111 and 112 and may secure stiffness.

In an example embodiment, a region other than the support portion 23, the connection portion 231, and the end portion 24 may be removed by $CO_2$ laser in a process of trimming the insulating substrate 25 after a process of plating the coil portions 42 and 44. By the trimming process, one portion of the insulating substrate 25 may be removed, and a volume occupied by a magnetic material in the body 50 may increase by the volume corresponding to the removed portion of the insulating substrate 25, thereby improving inductance properties of the coil electronic component 10 in the example embodiment.

Each of the first coil portion 42 and the second coil portion 44 may have a planar spiral form forming at least one turn with reference to a core portion 71 as a shaft. As an example, the first coil portion 42 may form at least one turn on one surface of the insulating substrate 25 with reference to the core portion 71 as a shaft.

The via electrode 46 may be formed of a material including a metal having high electrical conductivity, and may be formed of silver (Ag) , palladium (Pd) , aluminum (Al) , nickel (Ni) , titanium (Ti) , gold (Au) , copper (Cu) , platinum (Pt) , or alloys thereof, for example, but an example of the material may not be limited thereto.

The lead-out portions 62 and 64 may be exposed to the first surface 101 and the second surface 102 of the body 50. For example, the first lead-out portion 62 may be exposed to the first surface 101 and the third surface 103 of the body 50, and the second lead-out portion 64 may be exposed to the second surface 102 and the third surface 103 of the body 50.

Referring to FIG. 1, one end of the first coil portion 42 may extend from one surface of the insulating substrate 25 and may form the first lead-out portion 62, and the first lead-out portion 62 may be exposed to the first surface 101 and the third surface 103. Also, one end of the second coil portion 44 may extend from the other surface of the insulating substrate 25 and may form the second lead-out portion 64, and the second lead-out portion 64 may be exposed to the second surface 102 and the third surface 103 of the body 50.

Referring to FIGS. 1 to 6, the external electrodes 851 and 852 and the coil portions 42 and 44 may be connected to each other through the lead-out portions 62 and 64 disposed in the body 50, respectively.

The lead-out portions 62 and 64 may be disposed in the body and may have an "L" shaped form. An area in which the lead-out portions 62 and 64 of the example embodiment are disposed may be narrower than a width of the body 50. The lead-out portions 62 and 64 may extend from the first surface 101 and the second surface 102 of the body 50 and may be lead out to the third surface 103, respectively, and the lead-out portions 62 and 64 may not be disposed on the fourth surface 104, the fifth surface 105, and the sixth surface 106 of the body 50.

The lead-out portions 62 and 64 may include a conductive metal such as copper (Cu), and may be formed together with the coil portions 42 and 44 while the coil portions 42 and 44 are plated. As the lead-out portions 62 and 64 consecutively formed on the first to third surfaces 101, 102, and 103 of the body 50 are formed in the body 50, a contact area between the lead-out portions 62 and 64 and the external electrodes 851 and 852 may increase as compared to a general lower electrode structure, and accordingly, a size of the coil electronic component may decrease, and high capacity may be implemented.

The direction indicator 951 may be disposed on at least one of one surface and the other surface of the end portion 24 opposing each other. In an example embodiment, the direction indicator 951 may be disposed on both surfaces of the end portion 24 and may be configured to be connected to the first coil portion 42 and the second coil portion 44. According to a modified example, the direction indicator 951 may include a first direction indicating pattern 91 or a second direction indicating pattern 92 on one surface or the other surface of the end portion 24 . Referring to FIG. 6, as an example, the second direction indicating pattern 92 may be disposed on the other surface of the end portion 24, but an example embodiment thereof is not limited thereto. The first direction indicating pattern 91 may also be disposed on one surface of the end portion 24.

When the coil electronic component 10 of an example embodiment is mounted on a circuit substrate, mutual inductance may occur between the coil electronic component 10 and other adjacent elements, and accordingly, overall inductance may increase or may decrease. Also, when a mounting direction is reversed, a direction of magnetic flux generated when current flows in the coil portions 42 and 44 may also be reversed. In this case, as an effect affecting the other coil electronic components may change, the direction indicator 951 may be disposed to identify a direction of rotation of an internal coil. Thus, the coil electronic component 10 in the example embodiment may easily identify a mounting direction and a magnetic flux direction by the direction indicator 951 disposed on the fourth surface 104 of the body 50. Further, surfaces of the body 50 on which the external electrodes 851 and 852 are supposed to be disposed may be easily identified by the direction indicator 951.

In an example embodiment, the coil portions 42 and 44 and the direction indicator 951 may be formed through the same process. A plating resist 81 for forming the coil portions 42 and 44, the lead-out portions 62 and 64, and the direction indicator 951 may be integrally formed such that the direction indicator 951 may be plated while the coil portions 42 and 44 are plated. Thus, a direction indicator may be disposed in a coil electronic component having a reduced size without increasing the number of processes as compared to an example in which a direction indicator is separately printed or is etched by irradiating laser on an upper surface or a side surface of the coil electronic component.

Referring to FIG. 3, at least one of the coil portions 42 and 44 and the direction indicator 951 may include at least one or more conductive layer. Referring to FIG. 4, the coil portions 42 and 44 may include a first coil layer 501 in contact with the insulating substrate 25 and a second coil layer 502 disposed on the first coil layer 501, and the direction indicator 951 may include a first conductor layer 51 and a second conductor layer 52 disposed on the first conductor layer 51.

As an example, when the coil portions 42 and 44 and the direction indicator 951 are formed on both surfaces of the insulating substrate 25 by a plating process, each of the coil portions 42 and 44 and the direction indicator 951 may include a seed layer 61, an electroless plating layer, and the first and second coil layers 501 and 502 and the first and second conductor layers 51 and 52, electroplating layers. The electroplating layer may have a single layer structure, or may have a multilayer structure. The electroplating layer having a multilayer structure may be formed in a conformal film structure in which one electroplating layers covers the other electroplating layer, or may be formed in a form in which one electroplating layer is layered only on one surface of the other electroplating layer. The seed layers 61 of the coil portions 42 and 44 and the seed layer 61 of the direction indicator 951 may be integrated with each other such that a boundary may not be formed therebetween, but an example embodiment thereof is not limited thereto. The electroplating layers of the coil portions 42 and 44 and the electroplating layer of the direction indicator 951 may be integrated with each other such that a boundary may not be formed therebetween, but an example embodiment thereof is not limited thereto.

Each of the coil portions 42 and 44 and the direction indicator 951 may be formed of a conductive material such as copper (Cu), aluminum (Al), silver (Ag), tin (Sn), gold (Au), nickel (Ni), lead (Pb), titanium (Ti), or alloys thereof. The first conductor layer 51 and the first coil layer 501 may include the same metal, and the second conductor layer 52 and the second coil layer 502 may include the same metal, but an example embodiment thereof is not limited thereto.

The connection patterns 111 and 112 may connect the direction indicating patterns 91 and 92 and the coil portions 42 and 44 to be integrated with each other. In an example embodiment, a first connection pattern 111 connecting the second direction indicating pattern 91 and the first coil portion 42 may be included, and a second connection pattern 112 connecting the second direction indicating pattern 92 and the second coil portion 44 may be included, as shown in FIG. 1. However, an example embodiment thereof is not limited thereto, and as illustrated in FIG. 6, only the second connection pattern 112 connecting the second direction indicating pattern 92 and the second coil portion 44 may be included, or, although not illustrated, only the first connection pattern 111 connecting the first direction indicating pattern 91 and the first coil portion 42 may be included. As shown in FIG. 6, the connection portion 231 existing in the embodiment shown in FIG. 1 may be removed by the trimming process; however, the present disclosure is not limited thereto. For example, although not shown in FIG. 6, the connection portion 231 existing in the embodiment shown in FIG. 1 may also be kept after the trimming process.

When the lead-out portions 62 and 64 are disposed in an "L" shaped form, the coil portions 42 and 44 and the lead-out portions 62 and 64 may be connected by connection conductors 31 and 32. In a modified example, by including the connection patterns 111 and 112 connecting the coil portions 42 and 44 and the direction indicating patterns 91 and 92 to be integrated with each other, a deviation of inductance caused by current flowing in more than one directions during a plating process may be alleviated, and the coil portions 42 and 44 and the lead-out portions 62 and 64 may be configured to be supported in an upper region of the body 50 as well. Electrical and physical connectivity between the coil portions 42 and 44 and the lead-out portions 62 and 64 may improve in directions of an upper portion of the body 50 in which the direction indicating patterns 91 and 92 are disposed and a lower portion of the body 50 in which the lead-out portions 62 and 64, formed in an "L" shaped form, are disposed.

In an example embodiment, a connection portion 231 disposed between the first and second connection patterns 111 and 112 and supporting the connection patterns 111 and 112 may further be included. A region of the insulating substrate 25 other than the connection portion 231(such a region may not include a tip of the insulating substrate 25 to support the first lead-out portion 62 and the first dummy lead-out portion 63, another tip of the insulating substrate 25 to support the second lead-out portion 64 and the first dummy lead-out portion 65, a portion of the insulating substrate 25 to support the connection conductors 31 and 32) may be removed during a trimming process, and a volume occupied by a magnetic material in the body 50 may increase by the volume corresponding to the removed region, thereby improving inductance properties of the coil electronic component 10.

The insulating film 30 may be disposed between the direction indicator 951 and the body 50, and may insulate the direction indicator 951 from a magnetic material of the body 50. In an example embodiment, as the first and second coil portions 42 and 44 and the first and second direction indicating patterns 91 and 92 are integrated with each other through the connection patterns 111 and 112, the insulating film 30 may extend along the first and second connection patterns 111 and 112. For example, the first coil portion 42, the first direction indicating pattern 91, and the first connection pattern 111 may be integrated with one another, and may be filled with a plating layer, for example. Also, the insulating film 30 insulating the first coil portion 42, the first direction indicating pattern 91, and the first connection pattern 111 in integrated form may be disposed. Similarly, the second coil portion 44, the second direction indicating pattern 92, and the second connection pattern 112 may be plated and filled in an integrated manner, and the insulating film 30 insulating the second coil portion 44, the second direction indicating pattern 92, and the second connection pattern 112 in an integrated manner may be disposed.

The insulating film 30 may cover the coil portions 42 and 44 such that the insulating film 30 may prevent a magnetic material forming the body 50 from being in directly contact with the coil portions 42 and 44. The insulating film 30 may be formed by coating an insulating material such as parylene through a chemical vapor deposition (CVD) process, but the method is not limited thereto. The insulating film 30 may be formed by a well-known method such as a screen printing method, a process through exposure and developing of a photo resist (PR), a spray coating process, and the like.

The connection conductors 31 and 32 may be disposed on both surfaces of the insulating substrate 25 and may connect the lead-out portions 62 and 64 and the coil portions 42 and 44, respectively. For example, the first connection conductor 31 may be disposed on one surface of the insulating substrate 25 and may connect the first lead-out portion 62 and the first coil portion 42, and the second connection conductor 32 may be disposed on the other surface of the insulating substrate 25 and may connect the second lead-out portion 64 and the second coil portion 44.

In an example embodiment, a plurality of each of the connection conductors 31 and 32 maybe provided and may be spaced apart from each other, and accordingly, connection reliability of the coil portions 42 and 44 and the lead-out portions 62 and 64 may improve as compared to a structure in which each of the connection conductors 31 and 32 has a single form. As an example, as the first coil portion 42 and the first lead-out portion 62 maybe connected to each other through a plurality of the first connection conductors 31, spaced apart from each other, even when one of the first connection conductors 31 is broken, electrical and physical connection between the first coil portion 42 and the first lead-out portion 62 may be maintained through the remaining first connection conductors 31 which are not broken.

As a plurality of the connection conductors 31 and 32 are provided and are spaced apart from each other, the body between the connection conductors 31 and 32 may be charged. As an example, as a plurality of the first connection conductors 31 are disposed and are spaced apart from each other, the body may be charged in every space between the first connection conductors 31. Accordingly, cohesion force between the first connection conductor 31 and the body 50 may increase.

In an example embodiment, the coil portions 42 and 44, the lead-out portions 62 and 64 and the connection conductors 31 and 32 may be integrated with one another. A plating resist for forming the coil portions 42 and 44, the lead-out portions 62 and 64 and the connection conductors 31 and 32 may be formed in integrated form, and the lead-out portions 62 and 64 and the connection conductors 31 and 32 may be plated together while the coil portions 42 and 44 are plated.

Dummy lead-out portions 63 and 65 may be disposed on one surface and the other surface of the insulating substrate 25 opposing each other, respectively, to correspond to the lead-out portions 62 and 64. For example, the first dummy lead-out portion 63 may be disposed on the other surface of the insulating substrate 25, and may be disposed to correspond to the first lead-out portion 62 disposed on one surface of the insulating substrate 25. The second dummy lead-out portion 65 may be disposed on one surface of the insulating substrate 25 and may be disposed to correspond to the second lead-out portion 64 disposed on the other surface of the insulating substrate 25. By further including the lead-out portions 63 and 65 each having a shape symmetrical with the lead-out portions 62 and 64, in the coil electronic component 10, the external electrodes 851 and 852 may be formed more symmetrically by a plating process . Thus, the coil electronic component 10 in the example embodiment may be stably connected to a mounting surface.

Referring to FIGS. 1 to 6, the external electrodes 851 and 852 and the coil portions 42 and 44 may be connected through the lead-out portions 62 and 64 and the dummy lead-out portions 63 and 65 disposed in the body 50. The dummy lead-out portions 63 and 65 may be electrically connected to the lead-out portions 62 and 64 through a via (not illustrated) , and may be directly connected to the external electrodes 851 and 852. As the dummy lead-out portions 63 and 65 are connected to the external electrodes 851 and 852, cohesion strength between the external electrodes 851 and 852 and the body 50 may improve. As the body 50 includes an insulating resin and a magnetic metal material, and the external electrodes 851 and 852 include a conductive metal, the body 50 and the external electrodes 851 and 852 may not tend to be mixed with each other. Accordingly, by forming the dummy lead-out portions 63 and 65 in the body 50 and exposing the dummy lead-out portions 63 and 65 externally of the body 50, additional connection between the external electrodes 851 and 852 and the dummy lead-out portions 63 and 65 may be provided. As the connection between the dummy lead-out portions 63 and 65 and the external electrodes 851 and 852 may be connection between metals, adhesion force between the dummy lead-out portions 63 and 65 and the external electrodes 851 and 852 may be stronger than adhesion force between the body 50 and the external electrodes 851 and 852, and thus, cohesion strength of the external electrodes 851 and 852 with the body 50 may improve.

At least one of the coil portions 42 and 44, the via electrode 46, the lead-out portions 62 and 64, the connection conductors 31 and 32, and the dummy lead-out portions 63 and 65 may include at least one or more conductive layers.

As an example, the coil portions 42 and 44, the lead-out portions 62 and 64, the connection conductors 31 and 32, the dummy lead-out portions 63 and 65, and the via electrode 46 are formed on both surfaces of the insulating substrate 25 through a plating process, each of the coil portions 42 and 44, the lead-out portions 62 and 64, the connection conductors 31 and 32, the dummy lead-out portions 63 and 65, and the via electrode 46 may include a seed layer, an electroless plating layer, and an electroplating layer. The electroplating layer may have a single layer structure, or may have a multilayer structure. The electroplating layer having a multilayer structure may be formed in a conformal film structure in which one electroplating layer covers the other electroplating layer, or may be formed in a form in which one electroplating layer is layered only on one surface of the other electroplating layer. The seed layers of the coil portions 42 and 44, the seed layers of the lead-out portions 62 and 64, the seed layers of the connection conductors 31 and 32, the seed layers of the dummy lead-out portions 63 and 65, and the seed layer of the via electrode 46 may be integrated with one another such that a boundary may not be formed therebetween, but an example embodiment thereof is not limited thereto. The electroplating layers of the coil portions 42 and 44, the electroplating layers of the lead-out portions and 64, the electroplating layers of the connection conductors 31 and 32, the electroplating layers of the dummy lead-out portions 63 and 65, and the electroplating layer of the via electrode 46 may be integrated with one another such that a boundary may not be formed therebetween, but an example embodiment thereof is not limited thereto.

Each of the coil portions 42 and 44, the lead-out portions 62 and 64, the connection conductors 31 and 32, the dummy lead-out portions 63 and 65, and the via electrode 46 may be formed of a conductive material such as copper (Cu) , aluminum (Al) , silver (Ag) , tin (Sn) , gold (Au) , nickel (Ni), lead (Pb), titanium (Ti), or alloys thereof, but the material may not be limited thereto.

The external electrodes 851 and 852 may be disposed on the first surface 101, the second surface 102, and the third surface 103 of the body 50.

In an example embodiment, the first external electrode 851 connected to the first lead-out portion 62 exposed to the first surface 101 and the third surface 103 of the body 50 and the second external electrode 852 connected to the second lead-out portion 64 exposed to the second surface 102 and the third surface 103 maybe disposed. The first external electrode 851 may cover the first lead-out portion 62, may extend from the first surface 101 of the body 50, and may be disposed on the third surface 103, and may not be disposed on the fourth surface 104, the fifth surface 105, and the sixth surface 106 of the body 50. The second external electrode 852 may cover the second lead-out portion 64, may extend from the second surface 102 of the body 50, and may be disposed on the third surface 103, and may not be disposed on the fourth surface 104, the fifth surface 105, and the sixth surface 106 of the body 50. The external electrodes 851 and 852 may be formed along the shapes of lead-out portions 62 and 64 formed in an "L" shaped form, and an area in which the external electrodes 851 and 852 are disposed may be narrower than a width of the body 50.

The external electrodes 851 and 852 may have a single layer structure or a multilayer structure. Each of the external electrodes 851 and 852 may include a first layer covering the lead-out portions 62 and 64, and a second layer covering the first layer. In an example embodiment, the first layer may include nickel (Ni) , and the second layer may include tin (Sn).

FIG. 5 is a diagram illustrating processes of manufacturing a coil electronic component in order according to a modified example.

Referring to FIG. 5A, an insulating substrate 25 may be arranged, and a via hole 45 may be formed in the insulating substrate 25. The via hole 45 may be formed using a mechanical drill or a laser drill, but an example embodiment thereof is not limited thereto. The laser drill may be, for example, $CO_2$ laser or YAG laser.

Referring to FIG. 5B, a seed layer 61 may be formed on one surface or the other surface of the insulating substrate 25 opposing each other, and a plating resist 81 having an opening for forming a plating layer may be formed. The plating resist 81 may be a general photosensitive resist film, and a dry film resist, and the like, maybe used, but an example of the plating resist 81 may not be limited thereto. After coating the plating resist 81, an opening for forming a plating layer may be formed through exposure and developing processes. The opening may be formed to correspond to the coil portions 42 and 44, the connection patterns 111 and 112, the direction indicating patterns 91 and 92, the connection conductors 31 and 32, and the lead-out portions 62 and 64 described above.

The plating resist 81 and the opening may be preferentially formed on one surface of the insulating substrate 25, the plating resist 81 and the opening may be formed on the other surface of the insulating substrate 25, and the plating resist 81 and the opening may be formed together on one surface and the other surface of the insulating substrate 25 through the same process.

Referring to FIG. 5C, the first coil layer 501 (see FIG. 4) may be formed by filling the opening for forming a plating layer disposed on one surface or the other surface of the insulating substrate 25 opposing each other with a conductive metal. The first coil layer 501 may be formed by filling the opening for forming a plating layer with a conductive metal by an electroplating process, and the via electrode 46 may be formed by filling the via hole 45 with a conductive metal by an electroplating process.

During the electroplating process, by adjusting current density, concentration of a plating solution, a plating speed, and the like, the first coil layer 501 may be formed as an isotropic growth plating layer in which a degree of growth taken in a width direction may be similar to a degree of growth taken in a thickness direction. By forming the first coil layer 501 as an isotropic growth plating layer, a thickness difference between adjacent coils may be reduced such that the coils may have a uniform thickness, and accordingly, distribution of direct current resistance (Rdc) may decrease. Also, by forming the first coil layer 501 as an isotropic growth plating layer, the coil portions 42 and 44 may be formed straight without being bent such that shorts between adjacent coils may be prevented, and the defect in which the insulating film 30 is not formed in portions of the coil portions 42 and 44 may be prevented.

As the first coil layer 501 and the first conductor layer 51 are plated and filled in an integrated manner by the above-described electroplating process, the coil portions 42 and 44 and the direction indicator 951 may be integrated without performing an additional process.

Although not illustrated in detail, the second coil layer 502 (shown in FIG. 4) covering the first coil layer 501 may be formed on the first coil layer 501. As the second coil layer 502 and the second conductor layer 52 may be plated and filled in an integrated manner, the coil portions 42 and 44 and the direction indicator 951 may be formed in integrated form without performing a separate process, and by configuring the coil layers 501 and 502 to have two or more layers, an area of a cross-sectional surface of a coil conductor may further increase such that direct current resistance (Rdc) and inductance (Ls) properties may improve.

A plating process may be preferentially performed on the opening disposed on one surface of the insulating substrate 25, and the opening disposed on the other surface of the insulating substrate 25 may be filled with a conductive metal, but an example embodiment thereof may not be limited thereto. The openings disposed on one surface and the other surface of the insulating substrate 25 opposing each other may be filled with a conductive metal together during the same plating process.

Referring to FIG. 5D, the plating resist 81 may be removed, the seed layer 61 may be etched, and the seed layer 61 may only be remained on a lower surface of the first coil layer 501.

A method of plating the coil portions 42 and 44 may not be limited to the above-described example. The coil portions 42 and 44 may be formed by a method of forming the seed layer 61 in a shape of a coil pattern and forming the plating resist 81 on a side portion of the seed layer 61. The coil portions 42 and 44 may be formed by filling the opening for forming a plating layer with a conductive material and removing the plating resist 81.

Referring to FIG. 5E, a region of the insulating substrate 25 other than a region in which the coil portions 42 and 44 including the first and second coil layers 501 and 502 and the first and second conductor layers 51 and 52 are disposed may be removed (trimming process). A central portion of the insulating substrate 25 maybe removed, and a through-hole (not illustrated) may be formed. The removing of the insulating substrate 25 maybe performed using a mechanical drill, a laser drill, a sand blast, a punching process, and the like.

An insulating film 30 covering the first and second coil portions 42 and 44 may be formed. The insulating film 30 may be formed by a well-known method such as a screen printing method, a process through exposure and developing of photo resist (PR) , a spray coating process, a vapor deposition process, or the like.

Referring to FIG. 5F, the body 50 may be formed by layering, pressuring, and curing magnetic material sheets in an upper portion and a lower portion of the first and second coil portions 42 and 44. The through-hole (not illustrated) may be filled with a magnetic material, thereby forming a core portion 71.

The external electrodes 851 and 852 may be formed on an external portion of the body 50 such that the external electrodes 851 and 852 may be connected to end portions of the first and second coil portions 42 and 44 exposed to a surface of the body 50, respectively.

Further Example Embodiment

Figure 7:
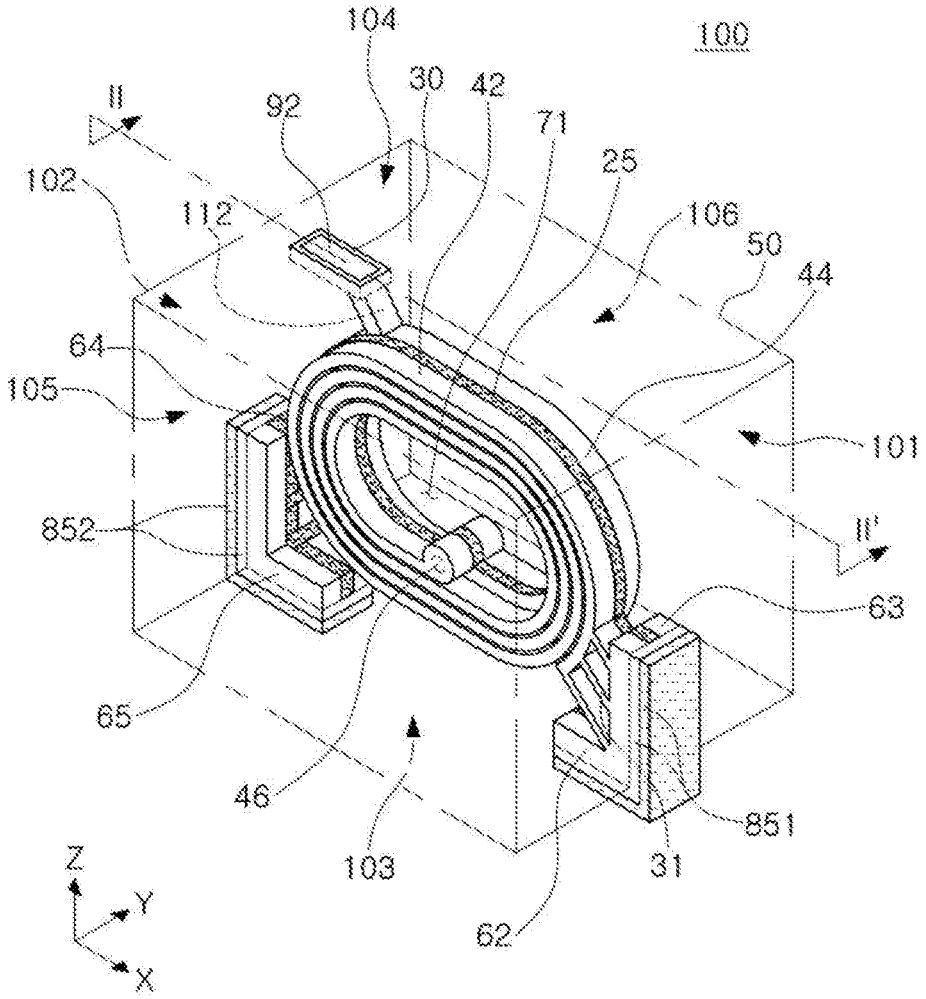
FIG. 7 is a perspective diagram illustrating a coil electronic component according to another modified example of the present disclosure.
Figure 8:
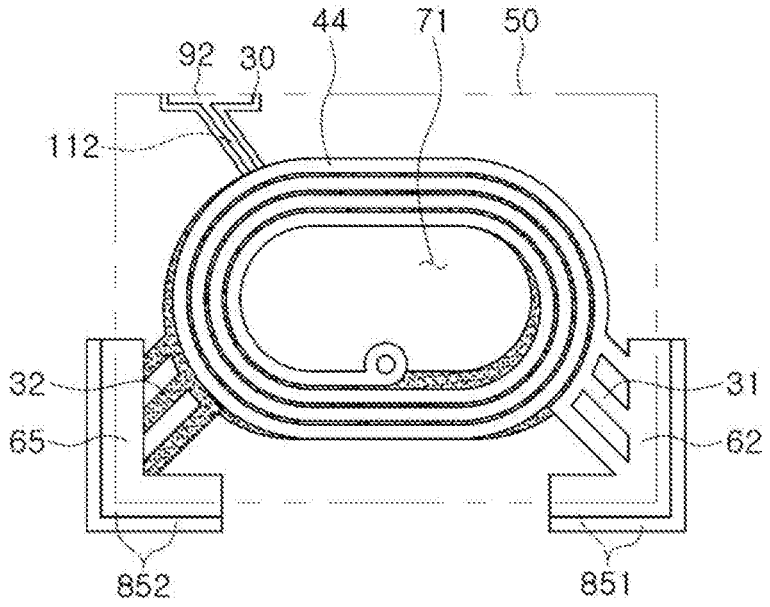
FIG. 8 is a diagram illustrating a body of a coil electronic component illustrated in FIG. 7 viewed from a fifth surface of the body.

FIG. 7 is a perspective diagram illustrating a coil electronic component according to another modified example. FIG. 8 is a diagram illustrating a body of a coil electronic component illustrated in FIG. 7 viewed from a fifth surface of the body.

Referring to FIGS. 7 and 8, as compared to the coil electronic component 10 described in the aforementioned example embodiment, a presence of the end portion 24, a portion of which is exposed to an upper surface 104 of a body 50, maybe different. Thus, in the example embodiment, only a shape of the end portion 24 will be described. The other elements of the example embodiment may be the same as in the aforementioned example embodiments.

According to another example embodiment, a region of the insulating substrate 25 corresponding to the end portion 24 in the aforementioned embodiment may be removed by $CO_2$ laser, and the like, during a process of trimming an insulating substrate 25 after a process of plating coil portions 42 and 44. By the trimming process, one region of the insulating substrate 25 in the body 50 may be removed. Referring to FIG. 7, the end portion 24 may be removed during the trimming process, and accordingly, a volume occupied by a magnetic material in the body 50 may increase by the volume corresponding to the removed region of the insulating substrate 25. Thus, as compared to an example in which the end portion 24 remains in the body 50, inductance properties of a coil electronic component 100 may further improve, and a size of the coil component may be reduced.

According to the aforementioned example embodiments, a direction of rotation of a coil may be easily identified in a direction of an upper surface of the coil electronic component without increasing the number of processes.

While the exemplary embodiments have been shown and described above, it will be apparent to those skilled in the art that modifications and variations could be made without departing from the scope of the present invention as defined by the appended claims.

What is claimed is:

1. A coil electronic component, comprising:

a body having a first surface and a second surface opposing each other, and a third surface and a fourth surface connecting the first surface and the second surface to each other and opposing each other;

an insulating substrate disposed in the body and including an end portion having one side surface exposed externally of the body;

first and second coil portions disposed on one surface and the other surface of the insulating substrate opposing each other, respectively;

a first lead-out portion connected to the first coil portion, disposed on the one surface of the insulating substrate and exposed from the body;

a second lead-out portion connected to the second coil portion, disposed on the other surface of the insulating substrate, and exposed from the body; and a direction indicator disposed on at least one of one surface and the other surface of the end portion opposing each other.

2. The coil electronic component of claim 1, further comprising:

first and second external electrodes covering the first and second lead-out portions, respectively.

3. The coil electronic component of claim 1, wherein the support substrate is exposed from the first to third surfaces.

4. The coil electronic component of claim 1, wherein the direction indicator comprises a first direction indicating pattern disposed on the one surface of the end portion and a second direction indicating pattern disposed on the other surface of the end portion.

5. The coil electronic component of claim 4, further comprising:

a first connection pattern connecting the first direction indicating pattern and the first coil portion to each other; and a second connection pattern connecting the second direction indicating pattern and the second coil portion to each other.

6. The coil electronic component of claim 5, wherein the first and second coil portions and the first and second direction indicating patterns are integrated with each other.

7. The coil electronic component of claim 5, further comprising:

an insulating film disposed between the first and second direction indicating patterns and the body.

8. The coil electronic component of claim 7, wherein the insulating film extends to the first and second connection patterns.

9. The coil electronic component of claim 5, wherein the insulating substrate further comprises a support portion disposed between the first and second coil portions and a connection portion disposed between the first and second connection patterns.

10. The coil electronic component of claim 1, wherein the first lead-out portion extends to the first and third surfaces, and the second lead-out portion extends to the second and third surfaces.

11. The coil electronic component of claim 10, wherein the direction indicator disposed on the fourth surface.

12. The coil electronic component of claim 10, further comprising:

a first external electrode disposed on the first and third surfaces and covering the first lead-out portion; and a second external electrode disposed on the second and third surfaces and covering the second lead-out portion.

13. A coil electronic component, comprising:

a body having a first surface and a second surface opposing each other, and a third surface and a fourth surface connecting the first surface and the second surface to each other and opposing each other;

an insulating substrate disposed in the body;

first and second coil portions disposed on one surface and the other surface of the insulating substrate opposing each other, respectively;

a first lead-out portion connected to the first coil portion, disposed on the one surface of the insulating substrate, and exposed from the body;

a second lead-out portion connected to the second coil portion, disposed on the other surface of the insulating substrate, and exposed from the body;

a direction indicator disposed in the body and having one side surface exposed externally of the body; and an insulating film disposed between the direction indicator and the body, wherein the direction indicator is connected to at least one of the first and second coil portions through a connection pattern different from the first and second lead-out portions.

14. The coil electronic component of claim 13, wherein the first lead-out portion extends to the first and third surfaces, and the second lead-out portion extends to the second and third surface, and the direction indicator is disposed on the fourth surface.

15. A coil electronic component, comprising:

a body;

an insulating substrate disposed in the body;

an internal coil portion disposed on at least one of one surface and the other surface of the insulating substrate opposing each other; and a direction indicator including a first conductor layer and a second conductor layer disposed on the first conductor layer, and disposed in the body and having one side surface exposed externally of the body, wherein the direction indicator is connected to the internal coil portion through at least one connection pattern.

16. The coil electronic component of claim 15, wherein the internal coil portion comprises a first coil layer in contact with the insulating substrate and a second coil layer disposed on the first coil layer, the first conductor layer and the first coil layer include the same metal, and the second conductor layer and the second coil layer include the same metal.

17. The coil electronic component of claim 15, further comprising:

an insulating film disposed between the direction indicator and the body.

18. The coil electronic component of claim 15, further comprising:

a first lead-out portion disposed on one surface of the insulating substrate and exposed from the body; and a second lead-out portion disposed on the other surface of the insulating substrate and exposed from the body.

19. The coil electronic component of claim 18, further comprising:

first and second external electrodes covering the first and second lead-out portions, respectively.

20. The coil electronic component of claim 19, wherein the first lead-out portion and the second lead-out portion extend to at least one surface of the body, the first and second external electrodes are disposed on at least the one surface of the body, and the direction indicator is disposed on the other surface of the body opposing the one surface.

21. The coil electronic component of claim 19, wherein the at least one connection pattern is spaced apart from the first and second external electrodes.

* * * * *